United States Patent [19]

Finn et al.

[11] 4,218,303

[45] Aug. 19, 1980

[54] COAL PYROLYSIS

[75] Inventors: Michael J. Finn; William R. Ladner, both of Cheltenham; John O. H. Newman, Southam, all of England

[73] Assignee: Coal Industry (Patents) Limited, London, England

[21] Appl. No.: 952,772

[22] Filed: Oct. 19, 1978

[30] Foreign Application Priority Data

Nov. 8, 1977 [GB] United Kingdom ..... 46384/77

[51] Int. Cl.[2] ..... C10G 1/00; C10L 1/04

[52] U.S. Cl. ..... 208/8 R; 208/15

[58] Field of Search ..... 208/8 R, 15

[56] References Cited

U.S. PATENT DOCUMENTS

| | | | |
|---|---|---|---|
| 1,659,930 | 2/1928 | Trumble | 208/8 R |
| 3,058,903 | 10/1962 | Otis | 208/8 R |

FOREIGN PATENT DOCUMENTS

| | | | |
|---|---|---|---|
| 629791 | 10/1961 | Canada | 208/8 R |
| 306435 | 2/1929 | United Kingdom | 208/8 R |
| 352672 | 7/1931 | United Kingdom | 208/8 R |
| 824495 | 12/1959 | United Kingdom . | |
| 837812 | 6/1960 | United Kingdom . | |
| 891971 | 3/1962 | United Kingdom . | |

*Primary Examiner*—Delbert E. Gantz
*Assistant Examiner*—William G. Wright
*Attorney, Agent, or Firm*—Stevens, Davis, Miller & Mosher

[57] ABSTRACT

Hydropyrolysis of coal can be done as a two stage process, offering good yields of benzene. The first stage is carbonization of coal in the presence of hydrogen or reactive gas at elevated pressure. The volatile products, without cooling or condensing, are then subjected to cracking at a temperature above the carbonization temperature, in the absence of catalyst, in the presence of hydrogen or reactive gas. The char remaining is reactive and can be gasified. The process is easier to control and offers many advantages compared to prior proposed single stage hydropyrolysis.

4 Claims, 1 Drawing Figure

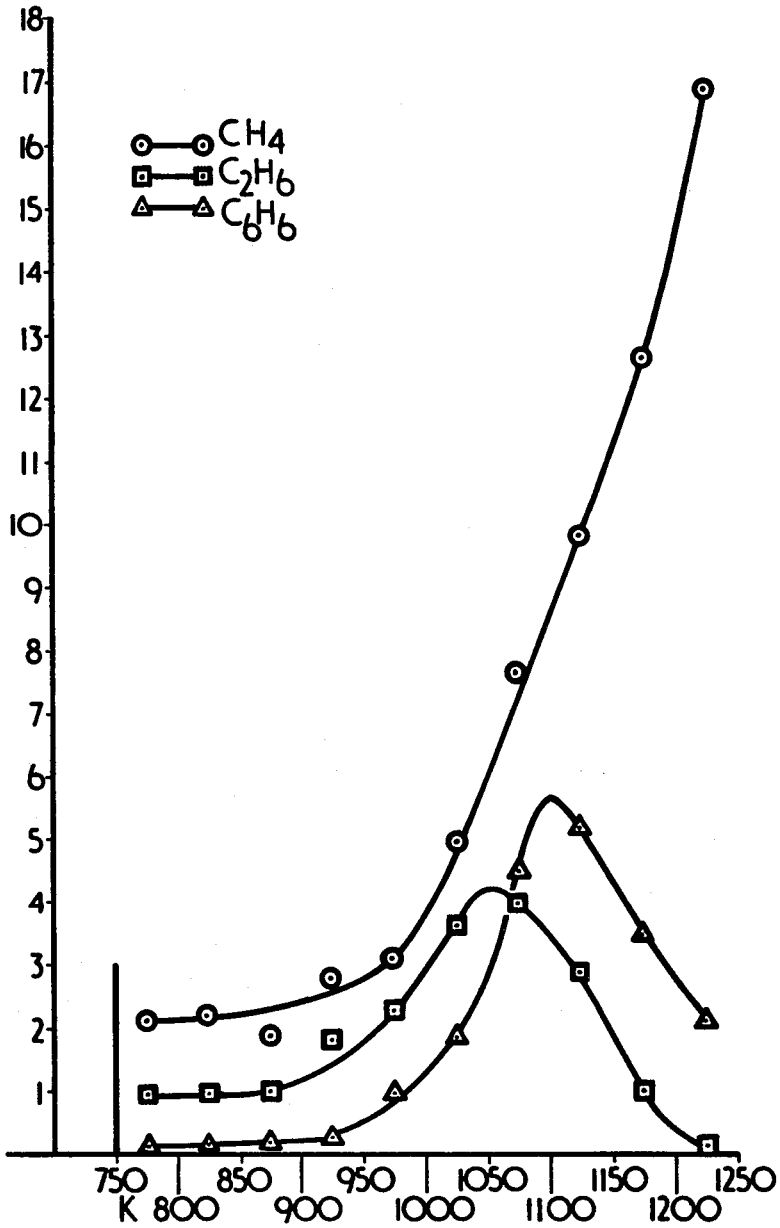
CH4
C2H6
C6H6
18
17
16
15
14
13
12
11
10
9
8
7
6
5
4
3
2
1
750
850
950
1050
1150
1250
K 800
900
1000
1100
1200

COAL PYROLYSIS

This invention concerns the hydropyrolysis of coal, more particularly in the production of single ring aromatic compounds from coal.

It has previously been proposed to hydropyrolyse coal, that is to say, pyrolyse coal in the presence of hydrogen under pressure, and interest was shown in the mononuclear aromatic hydrocarbons derived from this source. Such mononuclear aromatic hydrocarbons principally comprise benzene, toluene and xylenes and are hereinafter called "BTX". The majority of the work published to date has been done in the U.S.A., and has generally been on a very small scale since considerable emphasis has been placed on very high rates of heating of coal, so-called "flash" heating, as this would appear to maximise volatile and tar production. Most studies have used low-rank coals such as lignite, which inherently have a higher hydrogen content and a higher volatile content than the high-rank bituminous coals but some high volatile bituminous coals have been used. While the methods used in this prior experimental work vary, and include fixed bed and disperse phase hyropyrolysis, all published work has used a single stage process; it is certain that a variety of reactions occur in this stage.

The present invention provides a novel hydropyrolysis process which comprises devolatilising coal in the presence of hydrogen and/or other reactive gases, e.g. gas evolving hydrogen, under elevated pressure in a first carbonisation stage and then cracking the evolved volatiles, without cooling or condensation, in a second and non-catalytic stage in the presence of hydrogen and/or other reactive gases, the cracking stage being at a higher temperature than the carbonisation stage. It is preferred to use substantially pure hydrogen in both stages of the process and it is convenient to sweep the volatiles from the first stage using hydrogen then to pass the mixture directly to the second stage.

The carbonisation stage is carried out by heating the coal to a temperature in the range 750° to 950° K. It has been found that higher temperature within the range yield increased volatiles. In contrast to the previously reported flash hydropyrolysis in which, for example, heating rates as high as 650° $K.s^{-1}$ have been employed, the heating rate is not especially critical and successful results have been obtained at heating rates as low as 1° $K.s^{-1}$. The heating may be affected by any convenient method which permits the volatiles to be swept away from the coal by a stream of reactive gas, such as in a fluidised bed or entrained flow reactor; in batch-type experiments a tube containing a fixed bed was heated electrically. The carbonisation stage is carried out under elevated pressure, the hydrogen and/or reactive gas being, for example, at a pressure of up to 150 bar. The use of pressures as high as practical is advantageous but good yields can be obtained at c. 150 bar. The gas residence time does not appear to be critical so long as it is of the order of seconds rather than minutes; this is an important technical advantage compared to the prior art single stage processes.

The cracking stage is suitably carried out at a temperature in the range 950° to 1180° K. Higher temperatures within the range are generally advantageous. The mixture of hydrogen and/or reactive gas and volatiles under pressure is cracked with a residence time of up to 20 s, time and temperature being interdependent, i.e. a high cracking temperature requires a short residence time. For example, a cracking temperature in the range 1073° to 1173° K. is preferably used with a vapour residence time of 4 to 5 s. The pressure used for the cracking stage may be similar to that used for the devolatilisation stage, although it may be advantageous to use a lower pressure than in the devolatilisation stage. The cracking may be carried out in an open space reactor, conveniently a tube reactor; such a tube reactor may be an extension of the vessel in which the coal is devolatilised but in which the reaction conditions may be separately controlled.

It is preferred to rapidly cool or quench the cracked products, for example to less than 875° K. to limit their residence time under cracking conditions. This may be done by the injection of cold hydrogen gas or preferably by indirect means in heat exchangers, for example to pre-heat the hydrogen for the carbonisation stage or, more generally, to supply part of the heat for the carbonisation stage.

The products of the hydrocracking are mainly BTX (of which the major proportion is benzene), methane, ethane and small quantities of tar.

The quenched reaction products are then treated to recover the BTX; conventional technology permits the separation of BTX and methane from the hydrogen, at reaction pressure or at lower pressure. The hydrogen is suitably purified in conventional manner and recycled.

The coal used is preferably a high volatile coal, such as one of Coal Rank Code 700–900 (National Coal Board Classification System, 1964), although lignites may also be used. The coal used for the carbonisation stage is preferably of a small particle size, more preferably of less than 500 μm.

Thus the present invention provides a two-stage hydropyrolysis process which offers a number of advantages over the prior proposed processes:

(i) no catalysts are required;
(ii) the carbonisation and cracking reactions are separated, facilitating the design and control of a continuous process;
(iii) the product stream is easy to separate into its components and contains only low quantities of tar;
(iv) a good yield of BTX, mainly benzene, is obtained;
(v) there is no need to have high coal heating rates, with attendant problems of sophisticated and expensive equipment design;
(vi) the char is not agglomerated, and is a low temperature char rather than a high temperature char i.e. it is more reactive and more easily usable for gasification;
(vii) because the temperature of devolatilisation in the carbonisation stage is relatively low, compared with previous proposals, the contact time of the volatiles with the coal is not critical.

The invention will now be illustrated by the following examples.

EXAMPLE 1

A low rank bituminous coal (CRC 802, Linby Colliery, South Nottinghamshire Area) was ground to a particle size of less than 500 μm. A 10 g vacuum dried sample was placed in a 8 mm internal diameter stainless steel tube reactor and held in position between two wire wool plugs. The section of tube containing the coal was resistively heated and an extension of the tube preheated by wire wound electrical muffle heaters formed a vapour cracking space reactor.

The coal carbonisation section was heated at a rate of 1° K. $sec^{-1}$ to a temperature of 750° K. and the vapour cracking section was heated to a variety of temperatures. Hydrogen gas was passed through the tube at a rate to give a residence time of 5 sec in the cracking section and at a pressure of 100 bar. The gas containing the cracked vapour was quenched by passage through a cooled metal tube and then analysed for yield of benzene, ethane and methane as shown on the accompanying Figure. In the Figure, the vertical axis represents yield of product as a percentage of dry coal, and the horizontal axis represents cracking temperature, the vertical line at 750° K. representing the coal carbonisation temperature.

Maximum yields of benzene were obtained at approximately 1100° K., at which temperature the products were:

| | % by wt. of dry ash free coal |
|---|---|
| benzene | 5.6 |
| toluene | Nil |
| xylenes | Nil |
| methane | 10.4 |
| ethane | 3.1 |
| tar | 1.5 |
| naphthalene | 0.4 |

EXAMPLE 2

The low rank coal used in Example 1 was used ground to the same size and in the same tube reactor as in Example 1.

The coal carbonisation section was heated at 5° K. $s^{-1}$ to a temperature of 873° K. and maintained at this temperature for 10 minutes. The cracking section was heated to 1123° K. Hydrogen gas at 100 bar was passed through the tube reactor to give a vapour residence time of 4 to 5 s in the cracking section. The gas containing the cracked vapour was quenched by passage through a cooled metal tube and analysed for yields of BTX, methane, ethane and naphthalene. The product yields were:

| | % w/w on d.a.f. coal. |
|---|---|
| benzene | 8.7 |
| toluene | 0.05 |
| xylenes | Nil |
| methane | 33.9 |
| ethane | 5.2 |
| naphthalene | 1.8 |

EXAMPLE 3

Under the same conditions as Example 2, but using an increased hydrogen pressure of 150 bar, gave product yields of:

| | % w/w on d.a.f. coal. |
|---|---|
| benzene | 10.9 |
| toluene | 0.04 |

-continued

| | % w/w on d.a.f. coal. |
|---|---|
| xylenes | Nil |
| methane | 28.4 |
| ethane | 10.5 |
| naphthalene | 1.1 |

EXAMPLE 4

Using the same apparatus and conditions as Example 3, but using instead of the low rank Linby coal a high volatile cannel coal of 52.2% volatile matter on d.a.f. basis, from Lady Victoria colliery, the following product yields were obtained:

| | % w/w on d.a.f. coal. |
|---|---|
| benzene | 7.6 |
| toluene | 0.02 |
| xylenes | Nil |
| methane | 39.7 |
| ethane | 8.4 |
| naphthalene | 0.5 |

EXAMPLE 5

Using the same apparatus as in Example 1, a high volatile German brown coal of 52.8% volatile matter on a d.a.f. basis was heated to a carbonisation temperature of 750° K. at 1° $K.s^{-1}$. The vapour was cracked at 1073° K. for a residence time of 4 to 5 s, using a hydrogen pressure of 100 bar. The product yields were:

| | % w/w on d.a.f. basis. |
|---|---|
| benzene | 6.1 |
| toluene | 0.01 |
| xylenes | Nil |
| methane | 30.0 |
| ethane | 4.4 |
| naphthalene | 0.4 |

We claim:

1. A process for the production of a liquid mononuclear aromatic which is one or more of benzene, toluene and xylene, which consist essentially of the steps of
   (a) devolatilizing finely divided coal in the presence of substantially pure hydrogen, at a temperature of 750° to 950° K. and a pressure of 100 to 150 bar, in a first carbonization stage, and
   (b) without cooling or condensation of the products of step (a), cracking the evolved volatiles in a second and non-catalytic stage in the presence of substantially pure hydrogen at a temperature of 1073° to 1173° K. and a pressure of 100 to 150 bar and
   (c) quenching the products of step (b) to a temperature less than 875° K. and collecting the mononuclear aromatic liquid.

2. A process as claimed in claim 1, in which the coal is a high volatile coal.

3. A process as claimed in claim 1, in which the volatile residence time is from 4 to 5 seconds.

4. A process as claimed in claim 2, in which the coal has a particle size of less than 500 μm.

* * * * *